US008172501B2

(12) United States Patent
Nishizawa et al.

(10) Patent No.: US 8,172,501 B2
(45) Date of Patent: May 8, 2012

(54) COUNTER-ROTATING AXIAL-FLOW FAX

(75) Inventors: Toshiya Nishizawa, Tokyo (JP); Yasuhiro Maruyama, Tokyo (JP); Hayato Murayama, Tokyo (JP)

(73) Assignee: Sanyo Denki Co., Ltd., Tokyo (JP)

( * ) Notice: Subject to any disclaimer, the term of this patent is extended or adjusted under 35 U.S.C. 154(b) by 1056 days.

(21) Appl. No.: 12/104,848

(22) Filed: Apr. 17, 2008

(65) Prior Publication Data

US 2008/0260530 A1 Oct. 23, 2008

(30) Foreign Application Priority Data

Apr. 18, 2007 (JP) ..... 2007-109605

(51) Int. Cl.
*F04D 25/06* (2006.01)
*F04D 25/16* (2006.01)
*F04D 19/02* (2006.01)

(52) U.S. Cl. ..... 415/68; 415/214.1; 415/220; 416/128

(58) Field of Classification Search ..... 415/66, 415/68, 214.1, 220; 416/124, 128, 198 R, 416/199

See application file for complete search history.

(56) References Cited

U.S. PATENT DOCUMENTS 3,083,893 A * 4/1963 Dean ..... 417/247
6,565,334 B1 5/2003 Bradbury et al.
6,612,817 B2 * 9/2003 Lin et al. ..... 417/423.5
6,779,992 B2 * 8/2004 Lei et al. ..... 416/198 R
6,799,942 B1 * 10/2004 Tzeng et al. ..... 415/61
7,156,611 B2 1/2007 Oosawa et al.
7,445,423 B2 * 11/2008 Ishihara et al. ..... 415/61
7,828,519 B2 * 11/2010 Ishihara et al. ..... 415/191
7,872,381 B2 * 1/2011 Watanabe et al. ..... 310/58
7,909,568 B2 * 3/2011 Ishihara et al. ..... 415/61
7,946,805 B2 * 5/2011 Yoshida et al. ..... 415/66
2007/0059155 A1 3/2007 Ishihara et al.
2010/0119385 A1 * 5/2010 Hanaoka et al. ..... 417/244
2011/0142612 A1 * 6/2011 Kato et al. ..... 415/206

FOREIGN PATENT DOCUMENTS

JP 7-27265 5/1995
JP 2004-278371 10/2004

* cited by examiner

*Primary Examiner* — Nathaniel Wiehe
(74) *Attorney, Agent, or Firm* — Rankin, Hill & Clark LLP

(57) ABSTRACT

A support frame portion is divided into a first support-frame half-portion and a second support-frame half-portion along a virtual reference dividing plane. A raised portion is integrally formed with each of side walls in a pair of the first web half-portion, projecting toward the second web half-portion beyond the virtual reference dividing plane. A raised portion is integrally formed with each of side walls in a pair of the second web half-portion, projecting toward the first web half-portion beyond the virtual reference dividing plane. A recessed portion is formed in each of the side walls in the pair of the first web half-portion, and is fitted with the raised portion corresponding thereto of the second web half-portion. A recessed portion is formed in each of the side walls in the pair of the second web half-portion, and is fitted with the raised portion corresponding thereto of the first web half-portion.

7 Claims, 11 Drawing Sheets

COUNTER-ROTATING AXIAL-FLOW FAX

BACKGROUND OF THE INVENTION

The present invention relates to a counter-rotating axial-flow fan used for cooling the inside of an electric appliance or the like.

Japanese Patent Application Publication No. 2004-278371 (Patent Document 1) and Japanese Patent No. 3904595 (Patent Document 2) disclose a counter-rotating axial-flow fan including a housing which includes a housing body and a motor support frame. The housing body includes an air channel having a suction opening on one side in an axial line direction and a discharge opening on the other side in the axial line direction. The motor support frame is disposed in the central portion of the air channel. In this counter-rotating axial-flow fan, a first impeller that is rotated by a first motor is disposed within a first space that is defined between the motor support frame in the housing and the suction opening. Further, a second impeller that is rotated by a second motor is disposed within a second space that is defined between the motor support frame in the housing and the discharge opening. The first impeller rotates in a direction opposite to a rotating direction of the second impeller. The motor support frame includes a support frame body disposed in the central portion of the air channel, and a plurality of blades that connect the support frame body and the housing body. One of the webs includes therein a lead wire guide path that communicates with an internal space of the support frame body and is opened at an outer surface of the housing body. The lead wire guide path guides a plurality of lead wires that supply electric power to the first and second motors.

The housing is constituted from first and second divided housing units that are coupled through a coupling structure. The first divided housing unit includes a first housing-body half-portion and a first support-frame half-portion. The first housing half-portion has the suction opening at one end thereof and contains the first space therein. The first support-frame half-portion is obtained by dividing the motor support frame into two along a virtual reference dividing plane extending in a radial direction of rotary shafts orthogonal to the axial line direction. The second divided housing unit includes a second housing-body half-portion and a second support-frame half-portion. The second housing-body half-portion has the discharge opening at one end thereof and contains the second space therein. The second support-frame half-portion is obtained by dividing the motor support frame into two along the virtual reference dividing plane. The first support-frame half-portion and the second support-frame half-portion respectively include a first support-frame-body half-portion and a second support-frame-body half-portion, which are obtained by dividing the support frame body into tow so that the first and second support-frame-body half-portions are abutted onto each other on the virtual reference dividing plane. The first support-frame half-portion and the second support-frame half-portion also respectively include a plurality of first web half-portions and a plurality of second web half-portions, which are obtained by dividing the plurality of webs into two along the virtual reference dividing plane. The first and second web half-portions, which constitute the web including therein the lead wire guide path (lead-wire guide web), each include a pair of side walls. The pair of side walls of the first web half-portion and the pair of side walls of the second web half-portion (first and second lead-wire guide-web half-portions) are abutted onto each other on the virtual reference dividing plane when the first and second web half-portions are combined with each other.

In the conventional counter-rotating axial-flow fan, however, lead wires tend to run off from the first and second lead-wire guide-web half-portions when combining the first and second divided housing units. Consequently, the lead wires are easily sandwiched between the side walls of the first lead-wire guide-web half-portion and the side walls of the second lead-wire guide-web half-portion opposed to the first lead-wire guide-web half-portion when assembling the divided housing units. Thus, it becomes impossible to combine the first and second divided housing units.

SUMMARY OF THE INVENTION

An object of the present invention is therefore to provide a counter-rotating axial-flow fan in which lead wires do not become an obstacle to combining first and second divided housing units.

A counter-rotating axial-flow fan of the present invention comprises a housing, a first impeller, a first motor, a second impeller, a second motor, and a plurality of lead wires. The housing comprises a housing body including an air channel having a suction opening on one side in an axial line direction and a discharge opening on the other side in the axial line direction, and a motor support frame disposed in a central portion of the air channel. The first impeller is disposed in a first space, which is defined between the motor support frame in the housing and the suction opening, and includes a plurality of blades. The first motor includes a first rotary shaft onto which the first impeller is fixed, and rotates the first impeller in a first rotating direction within the first space. The second impeller is disposed in a second space, which is defined between the motor support frame in the housing and the discharge opening, and includes a plurality of blades. The second motor includes a second rotary shaft onto which the second impeller is fixed, and rotates the second impeller in a second rotating direction opposite to the first rotating direction within the second space. The plurality of lead wires include at least two lead wires for supplying electric power to the first and second motors.

The motor support frame comprises a support frame body disposed in the central portion of the air channel and a plurality of webs disposed between the support frame body and the housing body at predetermined intervals in a circumferential direction of the rotary shafts. The webs connect the support frame body and the housing body.

At least one of the webs communicates with an internal space of the support frame body and is opened at an outside surface of the housing body. This web includes therein a lead wire guide path that guides at least some of the lead wires.

The housing is constituted from first and second divided housing units that are coupled through a coupling structure. The first divided housing unit includes a first housing-body half-portion and a first support-frame half-portion. The first housing half-portion has the suction opening at one end thereof and contains the first space therein. The first support-frame half-portion is obtained by dividing the motor support frame into two along a virtual reference dividing plane extending in a radial direction of the rotary shafts orthogonal to the axial line direction. The second divided housing unit includes a second housing-body half-portion and a second support-frame half-portion. The second housing-body half-portion has the discharge opening at one end thereof and contains the second space therein. The second support-frame half-portion is obtained by dividing the motor support frame into the two along the virtual reference dividing plane. Here, the virtual reference dividing plane is defined as a virtual plane along which the motor support frame is divided into two, the first and second support-frame half-portions, and the actual shapes of the divided surfaces of the first and second support-frame half-portions are accordingly determined. Therefore, the virtual reference dividing plane may or may not coincide with the actual dividing surface (or a surface where two members are abutted onto each other).

The first support-frame half-portion and the second support-frame half-portion respectively include a first support-frame-body half-portion and a second support-frame-body half-portion, which are obtained by dividing the support frame body into tow so that the first and second support-frame-body half-portions are abutted onto each other on the virtual reference dividing plane. In other words, the virtual reference dividing plane coincides with the actual dividing surface. The first support-frame half-portion and the second support-frame half-portion also respectively include a plurality of first web half-portions and a plurality of second web half-portions, which are obtained by dividing the plurality of webs into two along the virtual reference dividing plane. Here, "dividing the webs into two along the virtual reference dividing plane" means that the webs are divided into two so that the actual dividing surface coincides with the virtual reference dividing plane, and may also mean that the webs are divided into two so that the actual dividing surface partially coincides with the virtual reference dividing plane though not completely.

The first and second web half-portions, which constitute the web including therein the lead wire guide path, each include a pair of side walls. The pair of side walls of the first web half-portion and the pair of side walls of the second web half-portion are abutted onto each other when the first and second web half-portions are combined with each other. One or more raised or convex portions are integrally formed with each of the side walls in the pair of the first web half-portion, projecting toward the second web half-portion beyond the virtual reference dividing plane. One or more raised or convex portions are integrally formed with each of the side walls in the pair of the second web half-portion, projecting toward the first web half-portion beyond the virtual reference dividing plane. Further, one or more recessed or concave portions are formed in each of the side walls in the pair of the first web half-portion, and are respectively fitted with the one or more raised portions corresponding thereto of the second web half-portion. One or more recessed or concave portions are formed in each of the side walls in the pair of the second web half-portion, and are respectively fitted with the one or more raised portions corresponding thereto of the first web half-portion.

With this arrangement, compared with when the web including the lead wire guide path therein is divided into two so that the dividing surface completely coincides with the virtual reference dividing plane, the height of the side wall portions may be increased by the length of the raised portions provided on the side walls in the pair of the first and second web half-portions and extending beyond the virtual reference dividing plane. As a result, lead wires may be much less likely to protrude or run off from between the side wall portions. In addition, when the first and second divided housing units are coupled, a plurality of lead wires may be much less likely to be sandwiched between the side wall portions of the first we half-portions and second web half-portions. When coupling the first and second divided housing units, the one or more raised portions provided on the pair of side walls of the first web half-portion are respectively fitted with the one or more recessed portions provided in the pair of side walls of the second web half-portions, and the one or more raised portions provided on the pair of side walls of the second web half-portion are respectively fitted with the one or more recessed portions provided in the pair of side walls of the first web half-portions. Thus, the web including the lead wire guide path therein is constructed.

One raised portion and one recessed portion may be formed in each of the side walls, and an end surface of the side wall where the raised and recessed portions are not formed may lie or be located in the virtual reference dividing plane. With this arrangement, the sizes and shapes of the raised and recessed portions may be determined in accordance with the virtual reference dividing plane, thereby simplifying the designing of raised and recessed portions.

one raised portion and one recessed portion formed in one of the side walls in the pair may be opposed, in the circumferential direction, to one raised portion and one recessed portion formed in the other side wall in the pair. With this arrangement, the height of the pair of side walls will be increased in locations where the raised portions are opposed to each other, thereby securely accommodating lead wires in the lead wire guide path. Accordingly, the lead wires are positively prevented from running off from between the first and second lead-wire guide-web half-portions.

The contour shape of a raised portion and the contour shape of a recessed portion are arbitrary. For example, the shapes of the raised and recessed portions may respectively be a trapezoid. In this arrangement, the raised portion will become narrower toward the leading end thereof, and the recessed portion will have a wider opening. Consequently, fitting of the raised and recessed portions may smoothly be completed. Preferably, the contour shape of a raised portion and the contour shape of a recessed portion may respectively be an isosceles trapezoid having a pair of non-parallel opposite sides of equal length that correspond to two inclined surfaces of the raised portion and the recessed portion, and one of the two inclined surfaces of the raised portion may be continuous with one of the two inclined surfaces of the recessed portion adjacent to the raised portion. With this arrangement, no stages will be formed between the raised and recessed portions. Even if manufacturing precision is somewhat low, the first and second web half-portions may positively be fitted with each other. Further, a maximal mounting or locating space may be secured for the raised and recessed portions.

Preferably, only one of the webs may include the lead wire guide path therein, and all of the lead wires may pass through the lead wire guide path. With this arrangement, the number of webs in which a lead wired guide path is formed may be minimized, thereby lowering the probability that lead wires will be sandwiched between the first and second lead-wire guide-web half-portions.

Preferably, the webs other than the one web including therein the lead wire guide path may respectively be divided into two along the virtual reference dividing plane. With this arrangement, simple shapes may be available for the first and second web half-portions, thereby positively abutting the first and second web half-portions onto each other.

According to the present invention, compared with when the web including therein the lead wire guide path is divided into two so that the actual dividing surface completely coincides with the virtual reference dividing plane, the height of the pair of side walls may be increased by the length of the one or more raised portions extending beyond the virtual reference dividing plane, which are provided on the pair of side walls of each of the first and second web half-portions. Accordingly, the lead wires will be much less likely to run off from between the pairs of side walls opposed to each other. Further, when coupling the first and second divided housing units, the lead wires will also be much less likely to be sandwiched between the side walls of the first and second web half-portions.

BRIEF DESCRIPTION OF THE DRAWINGS

These and other objects and many of the attendant advantages of the present invention will be readily appreciated as the same becomes better understood by reference to the following detailed description when considered in connection with the accompanying drawings.

DETAILED DESCRIPTION OF PREFERRED EMBODIMENT

Figure 1:
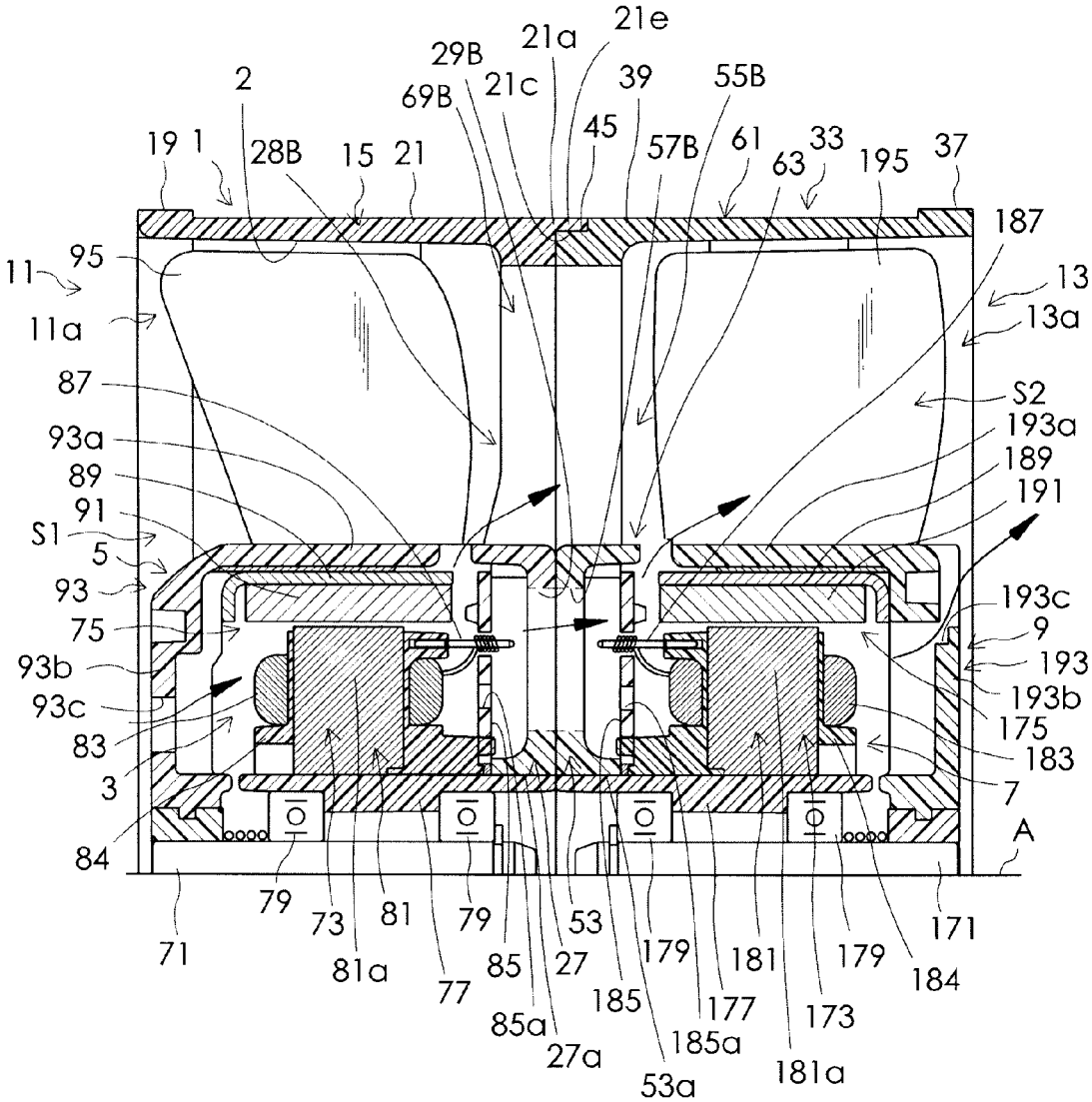
FIG. 1 is a cross-sectional view showing a half portion of a counter-rotating axial-flow fan in an embodiment of the present invention.
Figure 2:
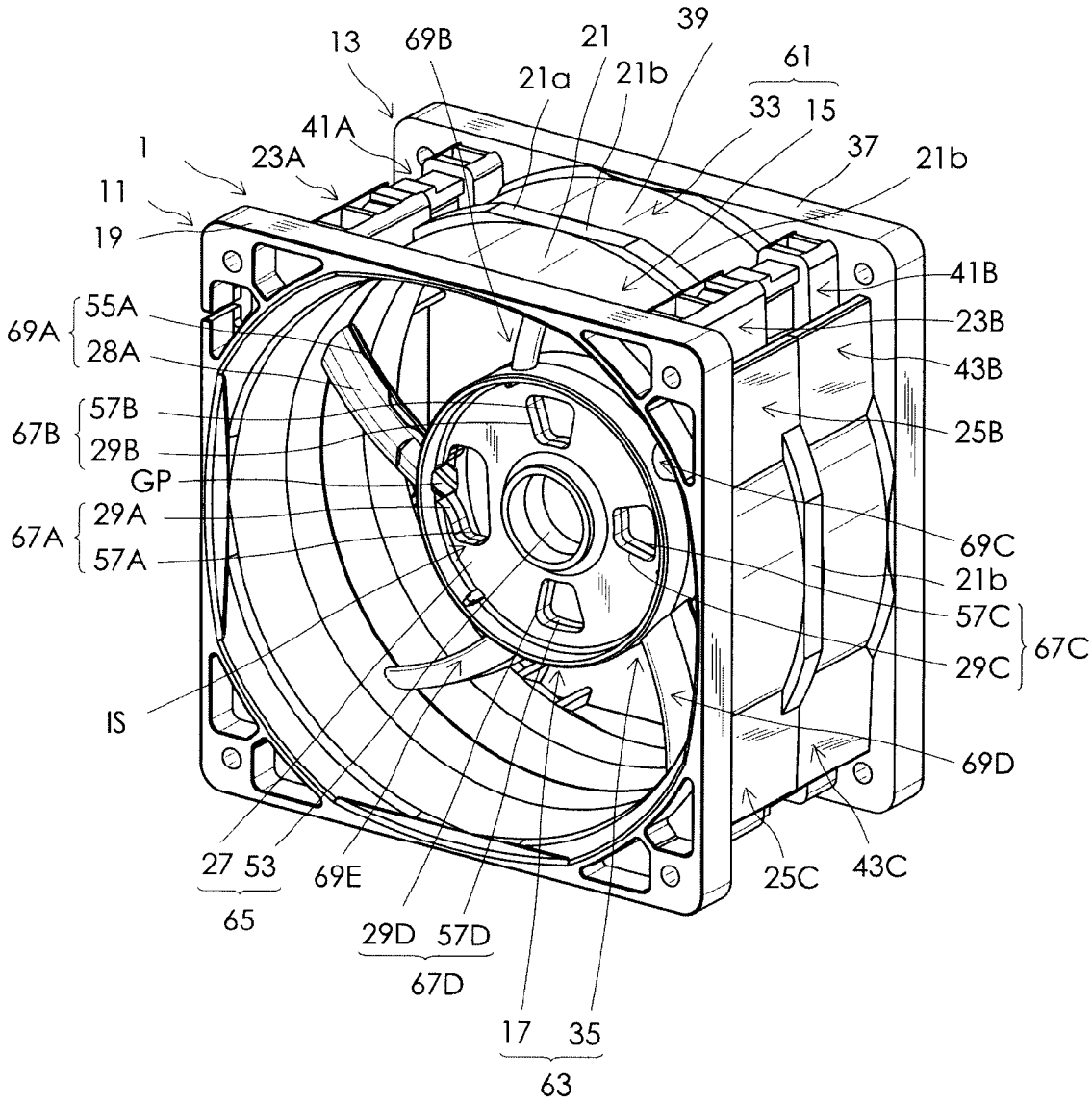
FIG. 2 is a perspective view of a housing of the counter-rotating axial-flow fan shown in FIG. 1.
Figure 3:
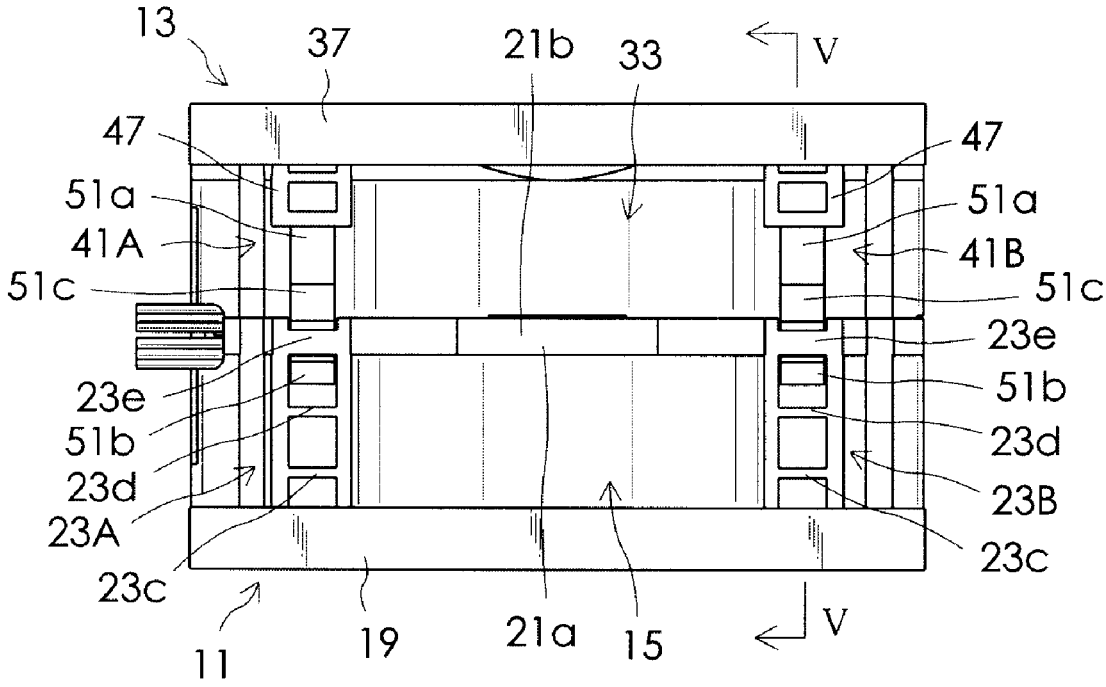
FIG. 3 is a plan view of the counter-rotating axial-flow fan shown in FIG. 1.
Figure 4:
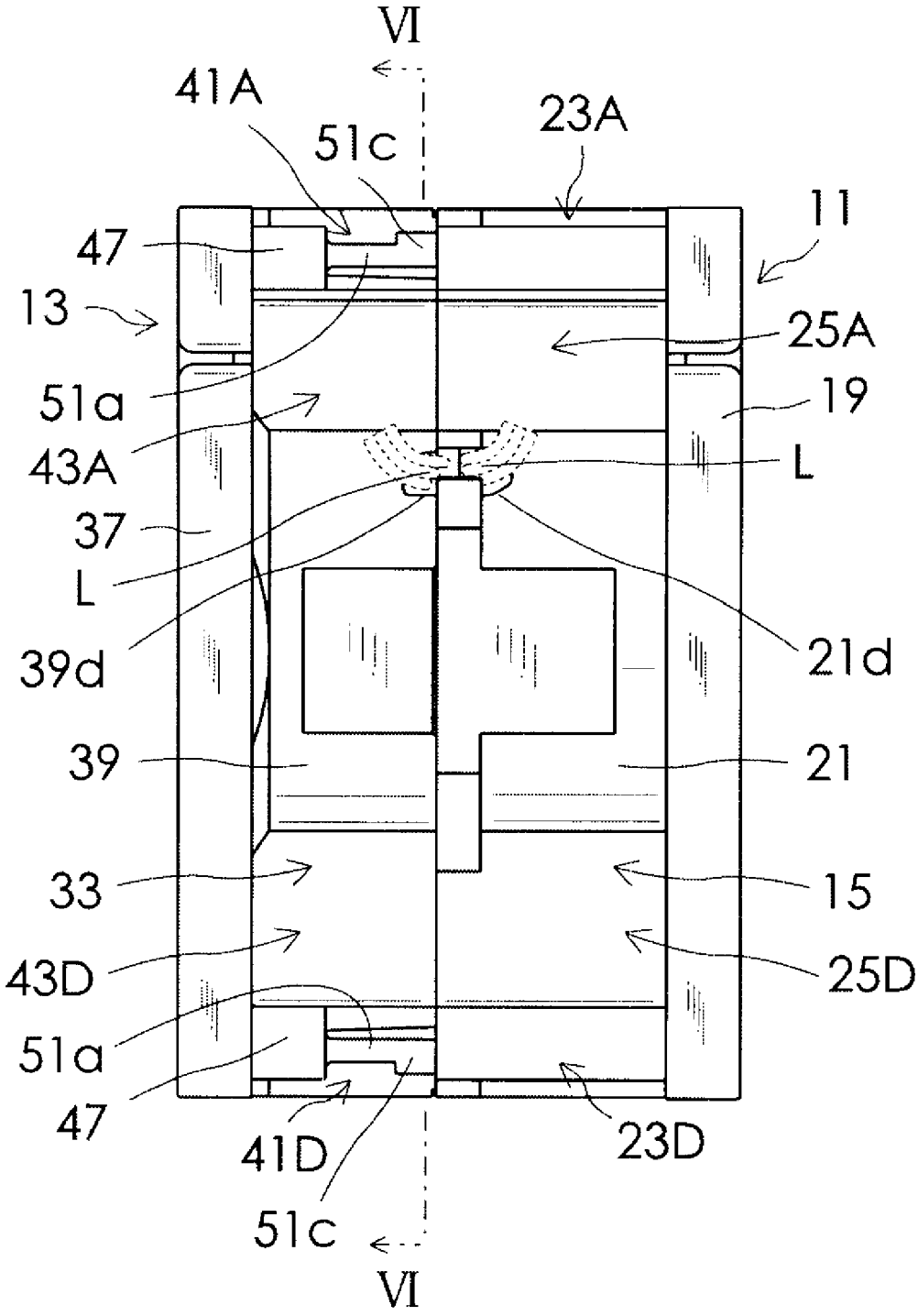
FIG. 4 is a left side view of the counter-rotating axial-flow fan shown in FIG. 1.
Figure 5:
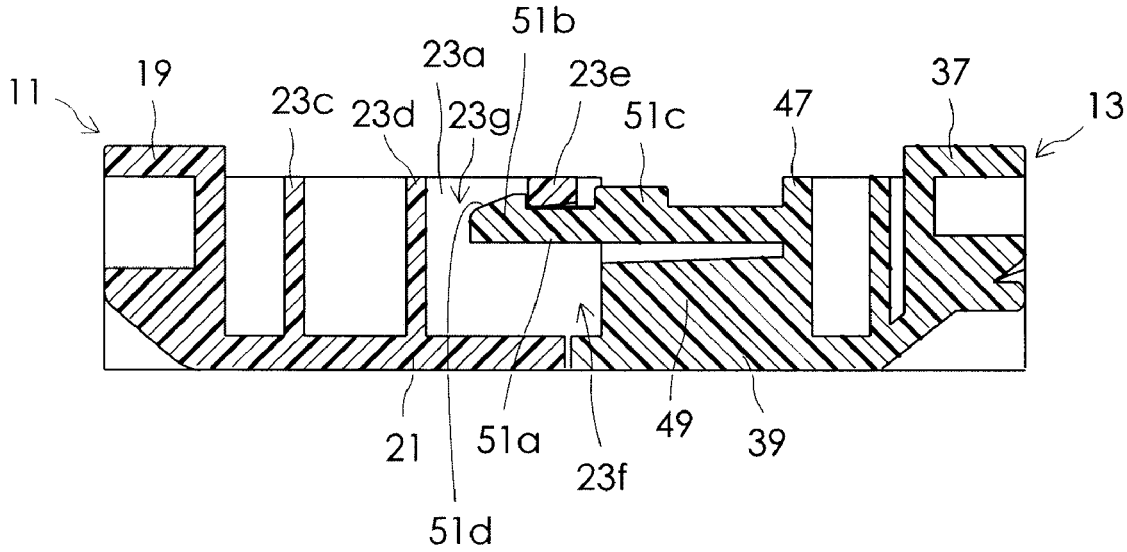
FIG. 5 is a partial cross-sectional view as taken along line V-V in FIG. 3.
Figure 6:
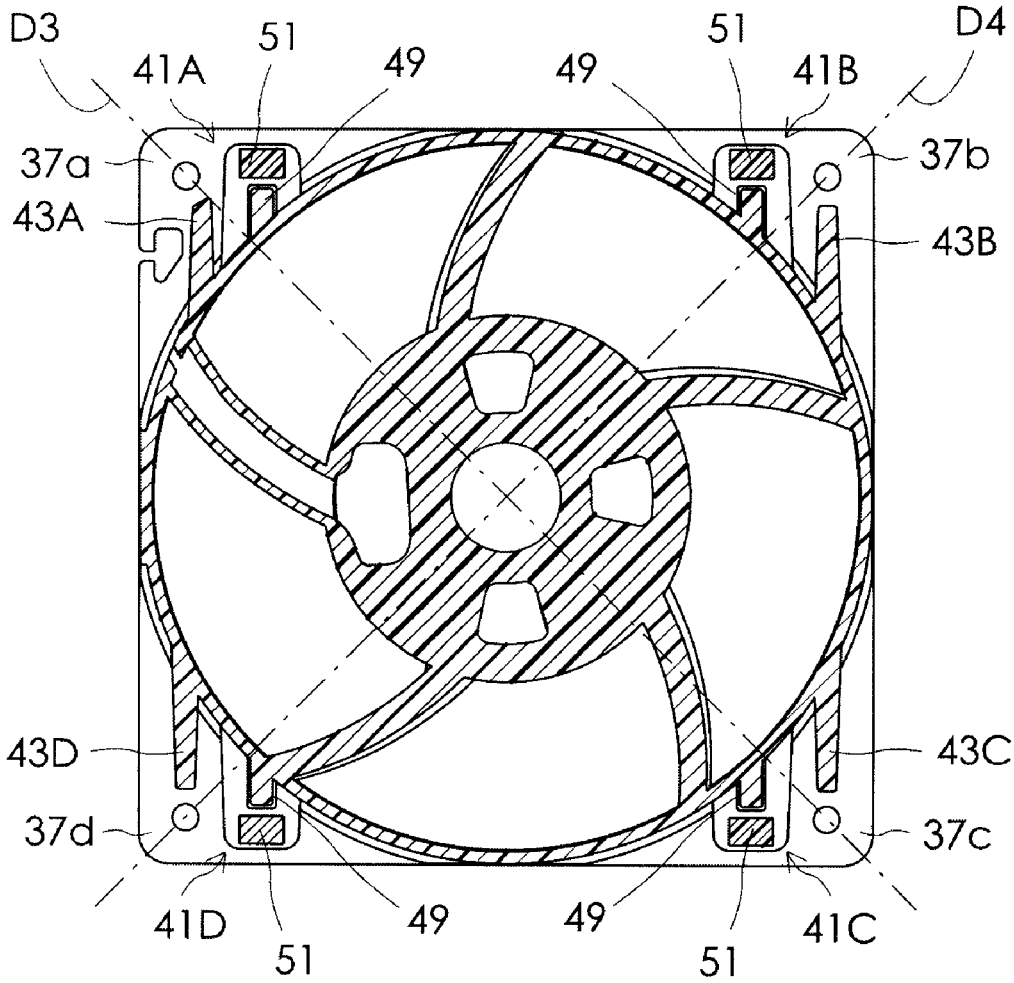
FIG. 6 is a cross-sectional view as taken along line VI-VI in FIG. 4.

Now, an embodiment of the present invention will be described in detail with reference to the accompanying drawings. FIG. 1 is a cross-sectional view showing a half portion of a counter-rotating axial-flow fan in the embodiment of the present invention. As shown in FIG. 1, the counter-rotating axial-flow fan in this embodiment includes a housing 1, a first motor 3, a first impeller 5, a second motor 7, and a second impeller 9. The housing 1 comprises a housing body 61 including an air channel 2, a motor support frame 6 disposed in a central portion of the air channel 2. Further, as shown in FIGS. 2 to 6, the housing 1 is constituted from a first divided housing unit 11 and a second divided housing unit 13 that are coupled through a coupling structure. FIGS. 2 to 4 are a perspective view of the housing 1, a plan view of the housing 1, and a left side view of the housing 1, respectively. FIG. 5 is a partial cross-sectional view as taken along line V-V in FIG. 3. FIG. 6 is a cross-sectional view as taken along line VI-VI in FIG. 4.

Figure 7:
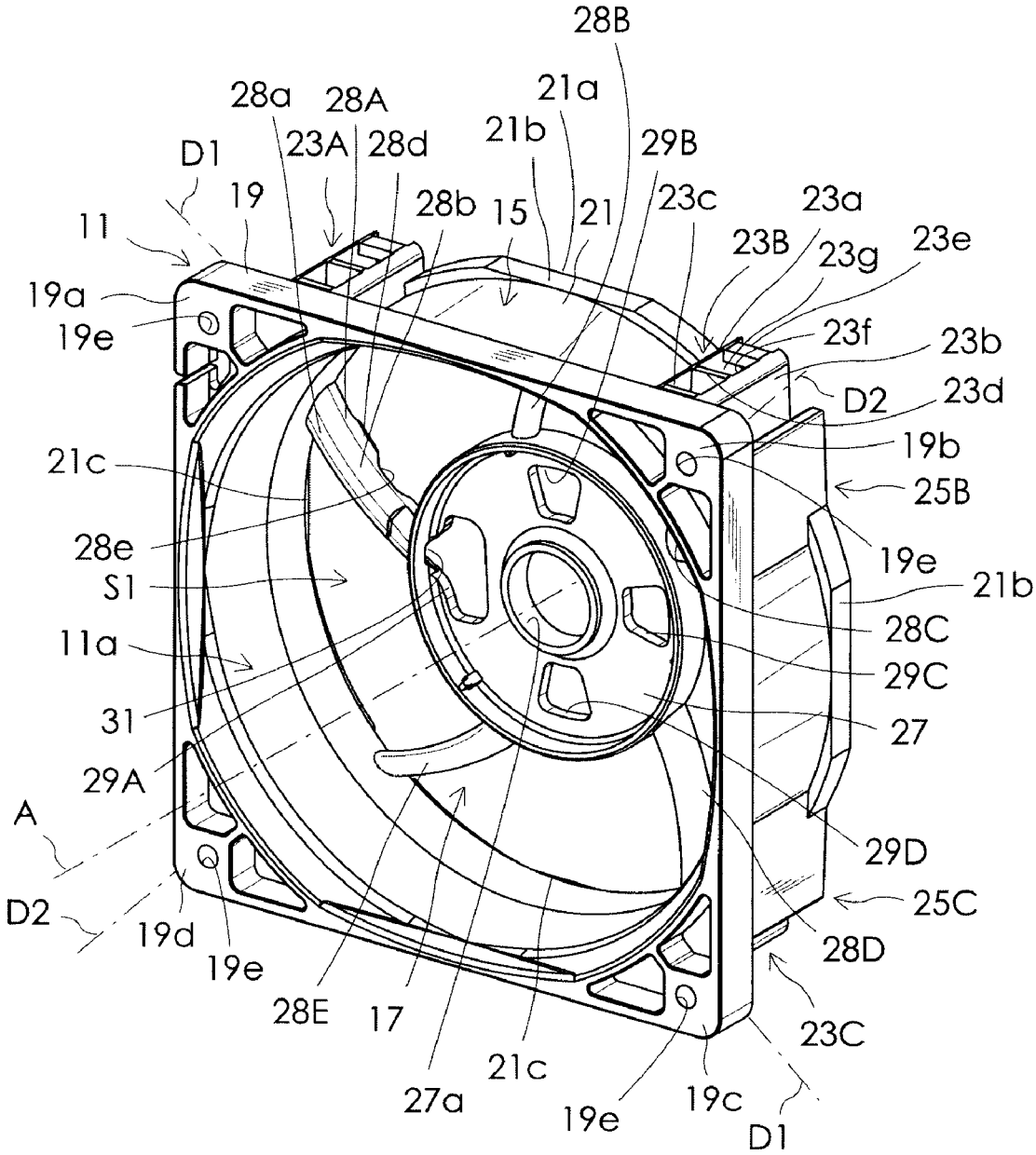
FIG. 7 is a perspective view of a first divided housing unit of the counter-rotating axial-flow fan shown in FIG. 1.

The first divided housing unit 11 is made of a synthetic resin or aluminum. As shown in FIG. 7, the first divided housing unit 11 integrally includes a first housing-body half-portion 15 and a first support-frame half-portion 17. The first housing-body half-portion 15 includes a first flange portion 19, a first cylindrical air-channel half-portion 21, four engaging members 23A to 23D, and four first stopper portions 25A to 25D. The first flange portion 19 has a contour of substantially a quadrilateral having four corners. The four corners, a first corner 19*a*, a second corner 19*b*, a third corner 19*b*, and a fourth corner 19*d* are disposed in a circumferential direction of a rotary shaft 71 of the first motor 3 and a rotary shaft 171 of the second motor 7 that are arranged on the same axis line A. This direction will be hereinafter simply referred to as the circumferential direction. The first divided housing unit 11 has a suction opening 11*a* at one end of the housing 1 in an axial line direction, which will be described later. A first space S1 is defined between the motor support frame 6 in the housing 1 and the suction opening 11*a*. The four corners of the first flange portion 19 are rounded. Then, a through-hole 19*e*, into which a fixture for mounting the counter-rotating axial-flow fan to an electric appliance is inserted, is formed in each of the four corners. One end of the first cylindrical air-channel half-portion 21 is integrally formed with the first flange portion 19. The first cylindrical air-channel half-portion 21 contains therein a major part of the first space S1. This first cylindrical air-channel half-portion 21 extends in the axial line direction of the rotary shafts 71 and 171 (which will be hereinafter simply referred to as the axial line direction). At four locations of an outer peripheral portion of the other end 21*a* of the first cylindrical air-channel half-portion 21, wall portions 21*b* that project outward in a radial direction of the rotary shafts 71 and 171 (which will be hereinafter simply referred to as the radial direction) are formed at equidistant intervals in the circumferential direction, respectively. At locations of an inner peripheral portion of the other end 21*a* of the first cylindrical air-channel half-portion 21, corresponding to the wall portions 21*b*, flat surface portions 21*c*, linearly extending, are respectively formed. In this embodiment, the inner peripheral portion of the other end 21*a* including the flat surface portions 21*c* constitutes a fitting portion.

As shown in FIGS. 3, 4, and 7, the four engaging members 23A to 23D are integrally formed with the first flange portion 19 and the first cylindrical air-channel half-portion 21, and are arranged at intervals in the circumferential direction. The four engaging members 23A to 23D are respectively engaged with four engaged members 41A to 41D of the second divided housing unit 13, which will be described later. The four engaging members 23A to 23D are respectively arranged in the vicinity of the four corners 19*a* to 19*d*, being integrally coupled to the first cylindrical air-channel half-portion 21. These four engaging members 23A to 23D extend in the axial line direction along the first cylindrical air-channel half-portion 21 so that the four engaging members 23A to 23D do not protrude outside from the contour of the first flange portion 19 as the flange portion is seen from the first cylindrical air-channel half-portion 21. By using the engaging member 23B shown in FIGS. 5 and 7 as a typical example and by assigning reference numerals to respective portions of the engaging member 23B, the structure of an engaging member will be described. Each of the engaging members 23A to 23D includes two plate portions 23*a* and 23*b* and three connecting portions 23*c* to 23*e* that are connected to the plate portions 23*a*, 23*b*. The plate portions 23*a* and 23*b* are opposed to each other in a direction orthogonal to the axial line direction and a vertical direction in the pages of FIGS. 5 and 7. The three connecting portions 23*c* to 23*e* are arranged at predetermined intervals in the axial line direction. The two connecting portions 23*c* and 23*d* completely extend in the vertical direction between the two plate portions 23*a* and 23*b* and partition a space defined between the two plate portions 23*a* and 23*b*. The connecting portion 23*e* connects only upper edge portions of the two plate portions 23*a* and 23*b*, slightly extending downward from between the two plate portions 23*a* and 23*b*. Thus, an opening portion 23*f* is formed among the two plate portions 23*a* and 23*b*, the connecting portion 23*e*, and the first cylindrical air-channel half-portion 21. A hole portion 23*g* that faces upward is formed between the connecting portions 23*d* and 23*e*.

The four first stopper portions 25A to 25D respectively have a shape of substantially a rectangular flat plate, being integrally formed with the first flange portion 19. Base portions of the first stopper portions are integrally coupled to the first cylindrical air-channel half-portion 21. The four stopper portions 25A to 25D extend in the axial line direction along the first cylindrical air-channel half-portion 21 so that the four stopper portions 25A to 25D do not protrude outside from the contour of the first flange portion 19 as the first flange portion is seen from the first cylindrical air-channel half-portion 21. How the four first stopper portions 25A to 25B are disposed will be described later.

As shown in FIG. 7, the first support-frame half-portion 17 includes a first support-frame-body half-portion 27 and five first web half-portions 28A to 28E. The first support-frame-body half-portion 27 includes a circular plate portion 27*b* having an opening portion 27*a* in the center thereof and a peripheral wall portion 27*c* that extends in the axial line direction from an outer peripheral portion of the circular plate portion 27*b*. A first metal bearing holder 77 made of brass is fixedly fitted into the opening portion 27*a*, as shown in FIG. 1. A stator board 85 of the first motor 3 is disposed within a space defined, being bordered by the circular plate portion 27*b* and the peripheral wall portion 27*c*, as shown in FIG. 1. In the first support-frame-body half-portion 27, four first through-hole half-portions 29A to 29D that pass through the first support-frame-body half-portion 27 in the axial line direction of the rotary shaft 71 of the first motor 3 are formed. The four first through-hole half-portions 29A to 29D are formed at equidistant intervals in the circumferential direction. One through-hole half-portion 29A of the four first through-hole half-portions 29A to 29D communicates with an internal space of a first lead-wire guide-path half-portion 31 of the first web half-portion 28A, which will be described later.

Figure 8:
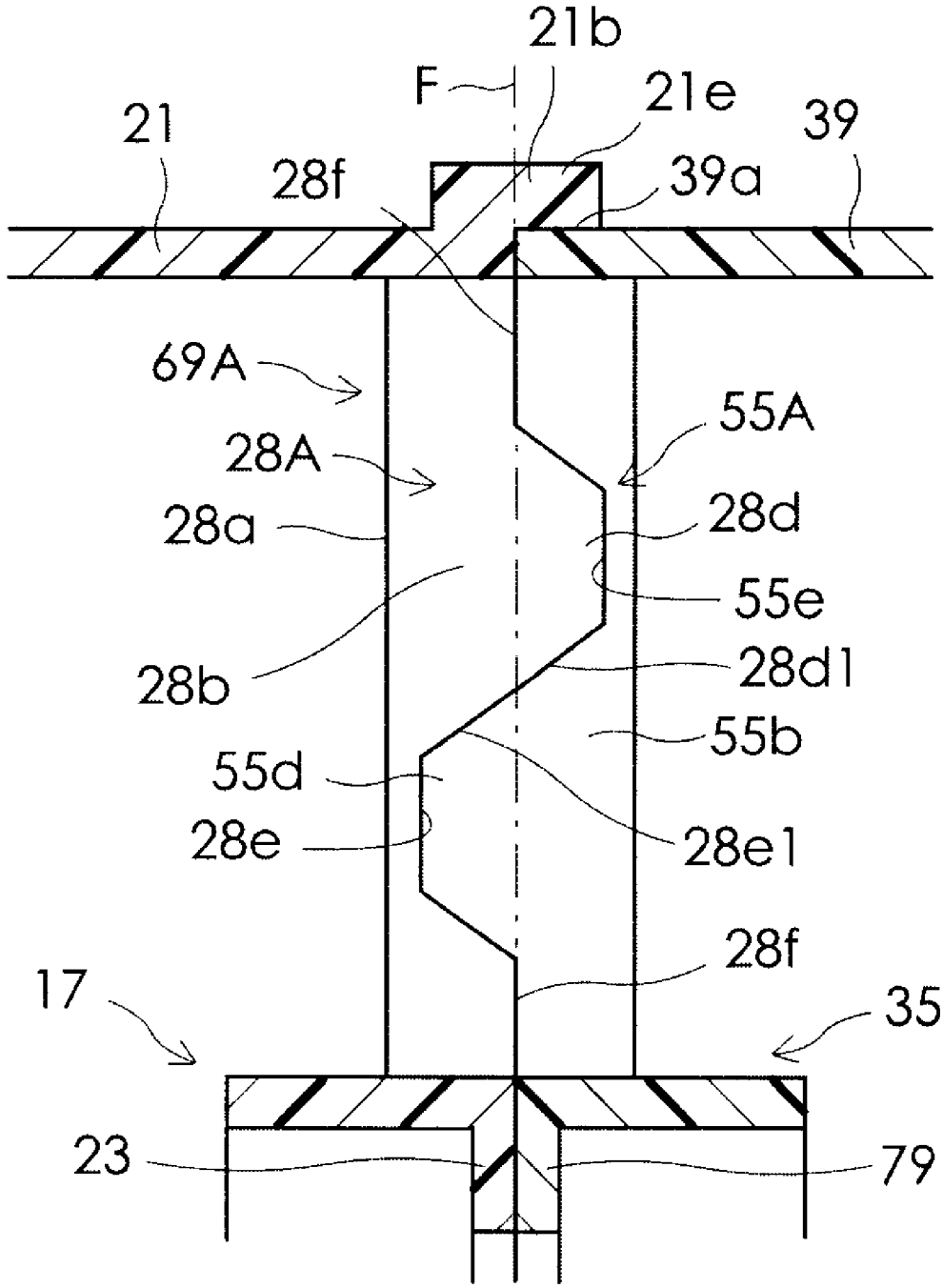
FIG. 8 is a diagram for explaining how a lead-wire guide web of the counter-rotating axial-flow fan shown in FIG. 1 is arranged.

Five first web half-portions 28A to 28E are disposed at predetermined intervals in the circumferential direction between the peripheral wall portion 27*c* of the first support-frame-body half-portion 27 and an inner peripheral surface of the first housing body half-portion 15, thereby coupling the first support-frame-body half-portion 27 and the first housing body half-portion 15. The first web half-portion 28A of the five first web half-portions 28A to 28E constitutes a web half-portion that includes therein the first lead-wire guide-path half-portion 31. This first web half-portion 28A will be hereinafter simply referred to as the first lead-wire guide web half-portion 28A. As shown in FIGS. 7 and 8, the first lead-wire guide web half-portion 28A includes a bottom wall 28*a* and a pair of side wall portions 28*b* that respectively rise up from the bottom wall 28*a* toward the second motor 7. The first lead-wire guide-path half-portion 31, as shown in FIG. 7, is formed by a region bordered by the bottom wall 28*a* and the pair of side wall portions 28*b*. As shown in FIG. 8, one raised or convex portion 28*d*, protruding toward a second lead-wire guide web half-portion 55A that will be described later, is formed on the side wall portions 28*b* in the pair. Then, one recessed or concave portion 28*e*, which is recessed toward the bottom wall 28*a*, is formed also in the side wall portions 28*b* in the pair. In this embodiment, the raised portion 28*d* and the recessed portion 28*e* provided at one of the side wall portions 28*b* in the pair are respectively opposed, in the circumferential direction, to the raised portion 28*d* and the recessed portion 28*e* provided at the other side wall portion 28*b* in the pair. The contour shapes of the raised portion 28*d* and the recessed portion 28*e* are respectively an isosceles trapezoid having two non-parallel opposite sides of equal length. The raised portion 28*d* and the recessed portion 28*e* respectively have two inclined surfaces which correspond to the trapezoid's pair of non-parallel opposite sides of equal length, and one of the two inclined surfaces 28*d*1 of the raised portion 28*d* is continuous with one of the two inclined surfaces 2*ie*1 of the recessed portion 28*e* adjacent to the raised portion 28*d*. The raised portion 28*d* protrudes toward the second lead-wire guide web half-portion 55A beyond a virtual reference dividing plane F. The virtual reference dividing plane F is the dividing plane along which a motor support frame is divided into two, the first support-frame half-portion 17 and the second support-frame half-portion 35 that will be described later. Then, an end surface 28*f* of each side wall portion 28*b* in the pair, except portions where the raised portion 28*d* and the recessed portion 28*e* are formed, lies or is in the virtual reference dividing plane F. Further, as shown in FIG. 4, an opening portion 21*d*, which opens toward an inside of the first lead-wire guide web half-portion 28A, is formed in the first cylindrical air-channel half-portion 21 in the vicinity of a location to which the first lead-wire guide web half-portion 28A is joined. Lead wires L are led out through the opening portion 21*d*.

Figure 9:
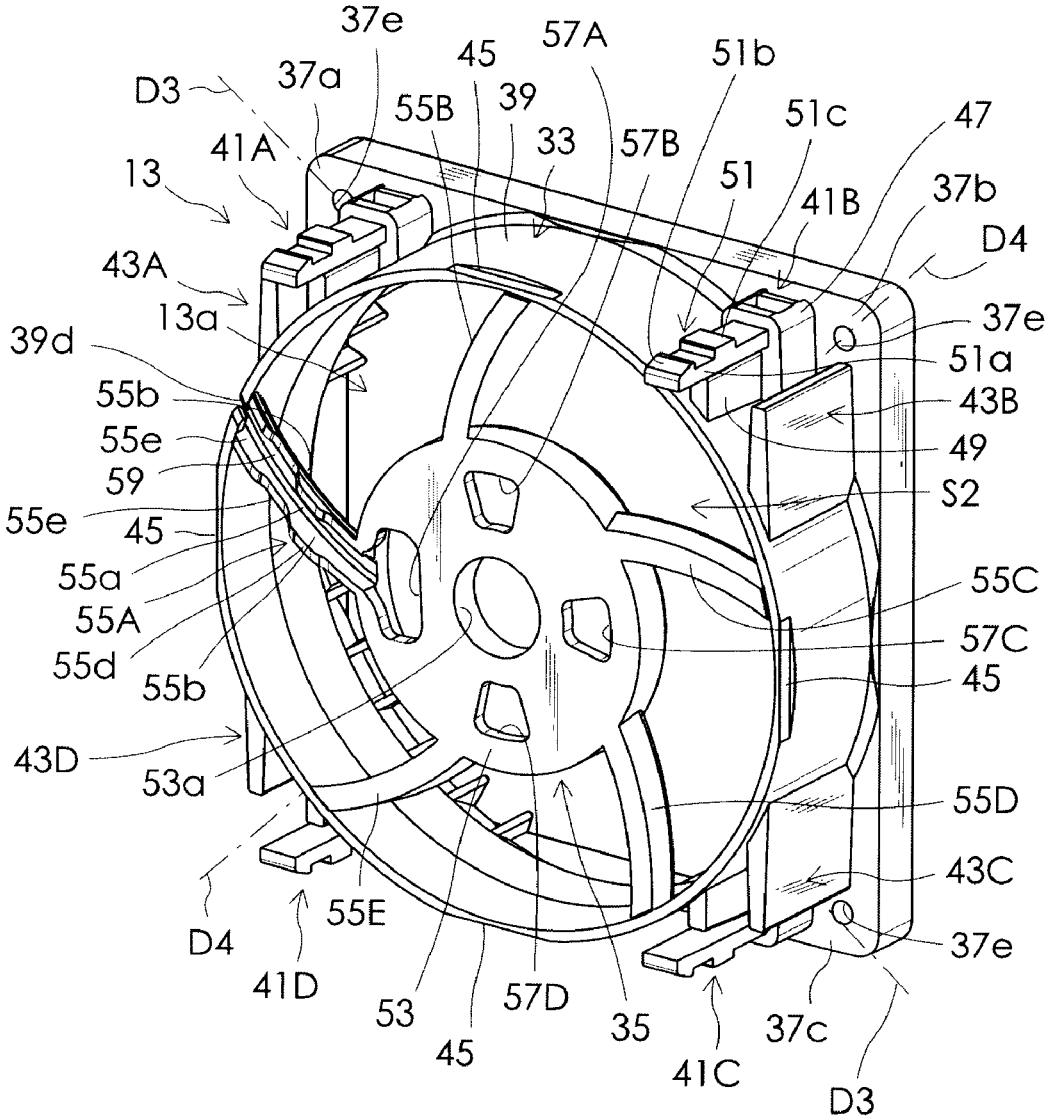
FIG. 9 is a perspective view of a second divided housing unit of the counter-rotating axial-flow fan shown in FIG. 1.

The second divided housing unit 13 is also made of a synthetic resin or aluminum. As shown in FIG. 9, the second divided housing unit 13 integrally includes a second housing-body half-portion 33 and a second support-frame half-portion 35. The second housing-body half-portion 33 includes a second flange portion 37, a second cylindrical air-channel half-portion 39, four engaged members 41A to 41D, and four second stopper portions 43A to 43D. The second flange portion 37 has a contour of substantially a quadrilateral having four corners. The four corners, a first corner 37*a*, a second corner 37*b*, a third corner 37*c*, and a fourth corner 37*d* are disposed in the circumferential direction. The second flange portion 37 has a discharge opening 13*a* at the other end of the housing 1 in the axial line direction. A second space S2 is defined between the motor support frame 6 in the housing 1 and the discharge opening 13*a*. The four corners 37*a* to 37*d* of the second flange portion 37 are rounded, and a through-hole 37*e*, into which the fixture for mounting the counter-rotating axial-flow fan to the electric appliance is inserted, is formed in each of the four corners. One end of the second cylindrical air-channel half-portion 39 is integrally formed with the second flange portion 37. The second cylindrical air-channel half-portion 39 contains therein a major part of the second space S2.

Four flat surface portions 45 are formed at equal angle intervals in the circumferential direction on an outer peripheral portion (a fitted portion) of the other end 39*a* of the second cylindrical air-channel portion 39. The four flat surface portions 45 come into contact with the flat surface portions 21*c* of the other end 21*a* of the first cylindrical air-channel half-portion 21 when the first divided housing unit 11 and the second divided housing unit 13 are coupled. Positioning of the first divided housing unit 11 and the second divided housing unit 13 in the circumferential direction is determined by aligning the flat surface portions 21*c* and the flat surface portions 45.

The four engaged members 41A to 41D are integrally formed with the second flange portion 37 and arranged at intervals in the circumferential direction. The four engaged members 41A to 41D are respectively disposed in the vicinity of the four corners 37*a* to 37*d* of the second flange portion 37 with the four engaged members 41A to 41D being integrally coupled to the second cylindrical air-channel half-portion 39.

The four engaged members 41A to 41D extend along the second cylindrical air-channel half-portion 39 in the axial line direction so that the four engaged members 41A to 41D do not protrude outside from the contour of the second flange portion 37 as the second flange portion is seen from the second cylindrical air-channel half-portion 39. By using the engaged member 41B shown in FIGS. 5 and 9 as a typical example and by assigning reference numerals to respective portions of the engaging member 41B, the structure of an engaged member 41B will be described. The engaged members 41A to 41D each include a support portion 47 integrally provided at the second flange portion 27, a rib 49 coupled to the support portion 47 and the second cylindrical air-channel half-portion 39, and a claw-forming member 51 with one end thereof supported by the support portion 47. The claw-forming member 51 includes a plate-like portion 51*a*, a claw portion 51*b* integrally formed with the plate-like portion 51*a*, and a projecting portion 51*c*. The plate-like portion 51*a* is connected to the support portion 47, being spaced from the rib 49. The plate-like portion 51*a* extends from the support portion 47 toward the first divided housing unit 11. The claw portion 51*b* projects from a leading end of the plate-like portion 51*a* in a direction orthogonal to the surface of the plate-like portion 51*a*, or in the upward direction in the page of FIG. 5. The upper side of the claw portion 51*b* has an inclined surface 51*d* so that the thickness of the claw portion 51*b* increases more toward the support portion 47. Specifically, the respective claw portions 51*b* of the engaged members 41A and 41B project in the upward direction in the page of FIG. 9, while the respective claw portions 51*b* of the engaged members 41C and 41D project in the downward direction in the page of FIG. 9. The projecting portion 51*c* is spaced from the claw portion 51*b* in the axial line direction. The projecting portion 51*c* projects from the plate-like portion 51*a* in the same direction as the one where the claw portion 51*b* projects. A cross-sectional surface of the projecting portion 51*c* is substantially a rectangle in shape. It will be described later in detail how he four engaged members 41A to 41D are respectively engaged with the four engaging members 23A to 23D of the first divided housing unit 11.

The four second stopper portions 43A to 43D have the shape of a rectangular flat plate integrally formed with the second flange portion 37, and are arranged adjacent to the four engaged members 41A to 41D, respectively. The four second stopper portions 43A to 43D are integrally coupled to the second cylindrical air-channel half-portion 39. The four second stopper portions 43A to 43D extend along the second cylindrical air-channel half-portion 39 in the axial line direction so that the four second stopper portions 43A to 43D do not protrude outside from the contour of the second flange portion 37 as the second flange portion is seen from the second cylindrical air-channel half-portion 39. The first corner 37*a* and the third corner 37*c* are opposed to each other in the radial direction with respect to the axis line A. The engaged members 41A and 41C are also opposed to each other in the radial direction. The second stopper portions 43A and 43C are provided for the engaged members 41A and 41C, respectively. Specifically, when a virtual diagonal line D3 that connects the first corner 37*a* and the third corner 37*c* of the second flange portion 37 is assumed as shown in FIGS. 6 and 9, the engaged member 41A and the second stopper portion 43A are arranged so as to interpose the virtual diagonal line D3 therebetween, and the engaged member 41C and the second stopper portion 43C are arranged so as to interpose the virtual diagonal line D3 therebetween. Likewise, the second corner 37*b* and the fourth corner 37*d* are opposed to each other in the radial direction with respect to the axis line A. The engaged members 41B and 41D are also opposed to each other in the radial direction. The second stopper portions 43B and 43D are provided for the engaged members 41B and 41D, respectively. When a virtual diagonal line D4 that connects the second corner 37*b* and the fourth corner 37*d*, which are the remaining two corners of the second flange portion 37, is assumed, the engaged member 41B and the second stopper portion 43B are arranged so as to interpose the virtual diagonal line D4 therebetween, and the engaged member 41D and the second stopper portion 43D are arranged so as to interpose the virtual diagonal line D4 therebetween. Then, at the four corners 37*a* to 37*d* through which the virtual diagonal lines D3 and D4 (the third and fourth virtual diagonal lines) pass, none of the engaged members 41A to 41D and none of the second stopper portions 43A to 43D are arranged. In other words, in a region defined between the first corner 37*a* and the second corner 37*b* of the second flange portion 37, the engaged members 41A and 41B are arranged, and in a region defined between the second corner 37*b* and the third corner 37*c*, the second stopper portions 43B and 43C are arranged. Then, in a region defined between the third corner 37*c* and the fourth corner 37*d*, the engaged members 41C and 41D are arranged, and in a region defined between the fourth corner 37*d* and the first corner 37*a*, the second stopper portions 43D and 43A are arranged.

The four first stopper portions 25A to 25D shown in FIGS. 4 and 7 are also arranged adjacent to the four engaging members 23A to 23D, respectively. A positional relationship among the four first stoppers 25A to 25D and the four engaging members 23A to 23D is the same as the positional relationship among the four second stopper portions 43A to 43D and the four engaged members 41A to 41D, shown in FIG. 6. As shown in FIG. 7, the first corner 19*a* and the third corner 19*c* are opposed to each other in the radial direction with respect to the axis line A. The engaging members 23A and 23C are opposed to each other in the radial direction. The first stopper portions 25A and 25C are provided for the engaging members 23A and 23C, respectively. Specifically, when a virtual diagonal line D1 that connects the first corner 19*a* and the third corner 19*c* of the first flange portion 19 is assumed as shown in FIG. 7, the engaging member 23A and the first stopper portion 25A are arranged so as to interpose the virtual diagonal line D1 therebetween, and the engaging member 23C and the first stopper portion 25C are arranged so as to interpose the virtual diagonal line D1 therebetween. The second corner 19*b* and the fourth corner 19*d* are opposed to each other in the radial direction with respect to the axis line A. The engaging members 23B and 23D are opposed to each other in the radial direction. The first stopper portions 25B and 25D are provided for the engaging members 23B and 23D, respectively. When a virtual diagonal line D2 that connects the second corner 19*b* and the fourth corner 19*d*, which are the remaining two corners of the first flange portion 19, is assumed, the engaging member 23B and the first stopper portion 25B are arranged so as to interpose the virtual diagonal line D2 therebetween, and the engaging member 23D and the first stopper portion 25D are arranged so as to interpose the virtual diagonal line D2 therebetween. Then, at the four corners 19*a* to 19*d* through which the virtual diagonal lines D1 and D2 (the first and second virtual diagonal lines) pass, none of the engaging members 23A to 23D and none of the first stopper portions 25A to 25D are arranged. In other words, in a region defined between the first corner 19*a* and the second corner 19*b* of the first flange portion 19, the engaging members 23A and 23B are arranged, and in a region defined between the second corner 19*b* and the third corner 19*c*, the first stopper portions 25B and 25C are arranged. Then, in a region defined between the third corner 19*c* and the fourth corner 19*d*, the engaging members 23C and 23D are arranged, and in a region defined between the fourth corner 19*d* and the first corner 19*a*, the first stopper portions 25D and 25A are arranged. The four first stopper portions 25A to 25D and the four second stopper portions 43A to 43D are shaped and sized so that leading ends of the four first stopper portions 25A to 25D are respectively abutted onto leading ends of the four second stopper portions 43A to 43D, when the claw portions 51*b* are completely engaged with the hole portions 23*g* of the engaging members 23A to 23D, respectively.

As shown in FIG. 9, the second support frame half-portion 35 includes a second support-frame-body half-portion 53 and five second web half-portions 55A to 55E. The second support-frame-body half-portion 53 includes a circular plate portion 53*b* having an opening portion 53*a* in the center thereof and a peripheral wall portion 53*c* that extends in the axial line direction from an outer peripheral portion of the circular plate portion 53*b*. A second metal bearing holder 177 made of brass is fixedly fitted into the opening portion 53*a*, as shown in FIG. 1. Within a space bordered by the circular plate portion 53*b* and the peripheral wall portion 53*c*, a stator board 185 of the second motor 7 is arranged, as shown in FIG. 1. Four second through-hole half-portions 57A to 57D that pass through the second support-frame-body half-portion 53 in the axial line direction of the rotary shaft 171 of the second motor 7, which will be described later, are formed in the second support-frame-body half-portion 53. The four second through-hole half-portions 57A to 57D are formed at equidistant intervals in the circumferential direction of the rotary shaft 171 (shown in FIG. 1). One through-hole half-portion 57A of the four second through-hole half-portions 57A to 57D communicates with an internal space of a second lead-wire guide-path half-portion 59 of the second web half-portion 55A, which will be described later. The four second through-hole half-portions 57A to 57D are formed to have the same shape as the four first through-hole half-portions 29A to 29D of the first support-frame-body half-portion 27, respectively. The five second web half-portions 55A to 55E are arranged at predetermined intervals in the circumferential direction between the peripheral wall portion 53*c* of the second support-frame-body half-portion 53 and an inner peripheral surface of the second housing-body half-portion 33, thereby connecting the second support-frame-body half-portion 53 and the second housing-body half-portion 33. The second web half-portion 55A of the five second web half-portions 55A to 55E constitutes the web half-portion that includes a second lead-wire guide-path half-portion 59 therein. Thus, the second web half-portion 55A will be hereinafter simply referred to as the second lead-wire guide web half-portion 55A. The second lead-wire guide web half-portion 55A includes a bottom wall 55*a* and a pair of side wall portions 55*b* that respectively rise up from the bottom wall 55*a*. The second lead-wire guide-path half-portion 59 is formed by a region bordered by the bottom wall 55*a* and the pair of side wall portions 55*b*. One raised or convex portion 55*d*, protruding toward the first lead-wire guide web half-portion 28A, is formed on the side wall portions 55*b* in the pair. Then, one recessed or concave portion 55*e*, which is recessed toward the bottom wall 55*a*, is formed also in the side wall portions 55*b* in the pair. In this embodiment, the raised portion 55*d* and the recessed portion 55*e* provided at one of the side wall portions 55*b* in the pair are respectively opposed, in the circumferential direction, to the raised portion 55*d* and the recessed portion 55*e* provided at the other side wall portion 55*b* in the pair. As shown in FIG. 8, the raised portion 55*d* protrudes toward the first lead-wire guide web half-portion 28A beyond the virtual reference dividing plane F, which is the dividing plane along which the motor support frame is divided into the first support-frame half-portion 17 and the second support-frame half-portion 35. As shown in FIGS. 4 and 9, an opening portion 39*d* that opens toward an inside of the second lead-wire guide web half-portion 55A is formed in the second cylindrical air-channel half-portion 39 in the vicinity of a location to which the second lead-wire guide web half-portion 55A is joined. It will be described in detail how the first lead-wire guide web half-portion 28A and the second lead-wire guide half-portion 55A are coupled.

In the counter-rotating axial-flow fan in this embodiment, the first divided housing unit 11 and the second divided housing unit 13 are coupled in the following manner. Actually, the first motor 3 (shown in FIG. 1) and the first impeller 5 are arranged within the first divided housing unit 11, and lead wires are arranged within the first lead-wire guide web half-portion 28A. A first axial-flow fan unit is thus assembled. Then, the second motor 7 (shown in FIG. 1) and the second impeller 9 are arranged within the second divided housing unit 13, and the lead wires are arranged within the second lead-wire guide web half-portion 55A. A second axial-flow fan unit is thus assembled. Then, by coupling the first axial-flow fan unit and the second axial-flow fan unit, the first divided housing unit 11 and the second divided housing unit 13 are coupled. First, the first divided housing unit 11 and the second divided housing unit 13 are brought close to each other, and then leading ends of the claw portions 51*b* of the four engaged members 41A to 41D of the second divided housing unit 13 are inserted into the opening portions 23*f* of the four engaging members 23A to 23D of the first divided housing unit 11, respectively. Referring to FIG. 5, when the engaged member 41B and the engaging member 23B are brought close to each other after the insertion, the inclined surface 51*d* of the claw portion 51*b* comes into contact with a lower edge of the connecting portion 23*e*. By the contact between the inclined surface 51*d* and the connecting portion 23*e*, the plate-like portion 51*a* bends so as to be closer to the rib 49. When the engaged member 41B and the engaging member 23B are further brought close to each other, and then the contact between the inclined surface 51*d* and the connecting portion 23*e* is released, the connecting portion 23*e* is fitted into a recessed or concave portion that is defined between the claw portion 51*b* and the raised portion 51*c* of the engaged member 41B. The claw portion 51*b* is thereby engaged with the hole portion 23*g*. This completes engagement between the engaging member 23B and the engaged member 41B. In this structure, the rib 49 functions as a stopper that prevents the claw-forming member 51 from bending more than necessary. The projecting portion 51*c* serves as a stopper that prevents the claw portion 51*b* from moving toward the first cylindrical air-channel half-portion 21. In this embodiment, the claw portion 51*b* and the hole portion 23*g* are formed so as to allow for visual confirmation of the engagement when the claw portion 51*b* is engaged with the hole portion 23*g*.

In order to attain the engagement as described above, the fitting portion formed by the inner peripheral surface portion of the other end 21*a* of the first cylindrical air-channel half-portion 21 is fitted into the fitted portion formed by the outer peripheral surface portion of the other end 39*a* of the second cylindrical air-channel half-portion 39, thereby forming a fitting structure. The first divided housing unit 11 is coupled to the second divided housing unit 13 not only by the fitting structure mentioned above but also by the engagement of the claw portions 51*b* mentioned above and the hole portions 23*g* of the engaging members 23A to 23D. Then, with the first divided housing unit 11 coupled to the second divided housing unit 13 as described above, leading ends of the first stopper portions 25A to 25D are respectively abutted onto leading ends of the four second stopper portions 43A to 43D.

A housing body 61 is constituted from the first housing-body half-portion 15 included in the first divided housing unit 11 and the second housing-body half-portion 33 included in the second divided housing unit 13 that are coupled as mentioned above and as shown in FIG. 2. Further, a motor support frame 63 is constituted from the first support-frame half-portion 17 included in the first divided housing unit 11 and the second support-frame half-portion 35 included in the second divided housing unit 13. In other words, as shown in FIG. 8, the first support-frame half-portion 17 and the second support-frame half-portion 35 are obtained by dividing the motor support frame 63 into two along the virtual reference dividing plane F that extends in the radial direction. Further, a support frame-body 65 is constituted from the first support-frame body half-portion 27 included in the first support-frame half-portion 17 and the second support-frame-body half-portion 53 included in the second support-frame half-portion 35. With this arrangement, the first through-hole half-portions 29A to 29D of the first divided housing unit 11 are respectively combined with the second through-hole half-portions 57A to 57D of the second divided housing unit 13, thereby forming four through-holes 67A to 67D. The four through-holes 67A to 67D partially define an internal space IS of the support frame body 65. Further, the five first web half-portions 28A to 28E included in the first support-frame half-portion 17 are respectively combined with the five second web half-portions 55A to 55E included in the second support-frame half-portion 35, thereby forming five webs 69A to 69E. The five webs 69A to 69E constitute stationary blades. Then, the web 69A of the five webs 69A to 69E constitutes the lead-wire guide web 69A. This lead-wire guide web 69A is constituted by combining the first lead-wire guide web half-portion 28A with the second lead-wire guide web half-portion 55A. In this lead-wire guide web 69A, as shown in FIG. 8, the raised portion 28*d* of the first lead-wire guide web half-portion 28A is fitted into the recessed portion 55*e* of the second lead-wire guide web half-portion 55A, and the recessed or concave portion 28*e* of the first lead wire guide web half-portion 28A is fitted with the raised or convex portion 55*d* of the second lead wire guide web half-portion 55A. Then, a lead-wire guide path GP (as shown in FIG. 2) is formed within the lead-wire guide web 69A. The lead-wire guide path GP guides a plurality of lead wires and a plurality of signal lines for supplying power to the first motor 3 and the second motor 7. Then, as shown in FIG. 4, a plurality of the lead wires L shown by dotted lines are led out from the lead wire guide path of the lead-wire guide web 69A through the opening portions 21*d* and 39*d*. The remaining four webs 69B to 69E of the five webs 69A to 69E are respectively divided into the first web half-portion 28B and the second web half-portion 55B, the first web half-portion 28C and the second web half-portion 55C, the first web half-portion 28D and the second web half-portion 55D, and the first web half-portion 28E and the second web half-portion 55E, along the virtual reference dividing plane F.

Referring again to FIG. 1, the first motor 3 includes the rotary shaft 71, a stator 73, and a rotor 75. The rotary shaft 71 is rotatably supported onto the first bearing holder 77 by two bearings 79 fitted into the first bearing holder 77.

The stator 73 includes a stator core 81, exciting windings 83, and a circuit board 85. The stator core 81 is formed by lamination of a plurality of steel plates and is fixed to the first bearing holder 77. The stator core 81 includes a plurality of projecting pole portions 81*a* arranged in the circumferential direction of the rotary shaft 71. The exciting windings 83 are respectively attached to the projecting pole portions 81*a* through insulators 84. The circuit board 85 is arranged along the first support-frame-body half-portion 27, being disposed apart from the first support-frame-body half-portion 27 by predetermined spacing. An exciting current supply circuit for flowing exciting current to the exciting windings 83 is mounted on the circuit board 85. In this embodiment, the exciting current supply circuit on the circuit board 85 and the exciting windings 83 are electrically connected by winding lead wires of the exciting windings 83 around a terminal pin 87 that passes through a through-hole of the circuit board 85 and is soldered to an electrode on the circuit board 85. In the circuit board 85, a plurality of board through-holes 85*a* are formed. The board through holes 85*a* are formed in the circumferential direction of the rotary shaft 71 at equidistant intervals. Air that has flown from around the stator 73 toward the four first through-hole half-portions 29A to 29D of the first support-frame-body half-portion 27 passes through the board through-holes 85*a*.

The rotor 75 includes an annular member 89 and a plurality of permanent magnets 91 fixed onto an inner peripheral surface of the annular member 89. The annular member 89 is fixed inside a peripheral wall portion 93*a* of a cup-like member 93 of the first impeller 5, which will be described later.

Figure 10:
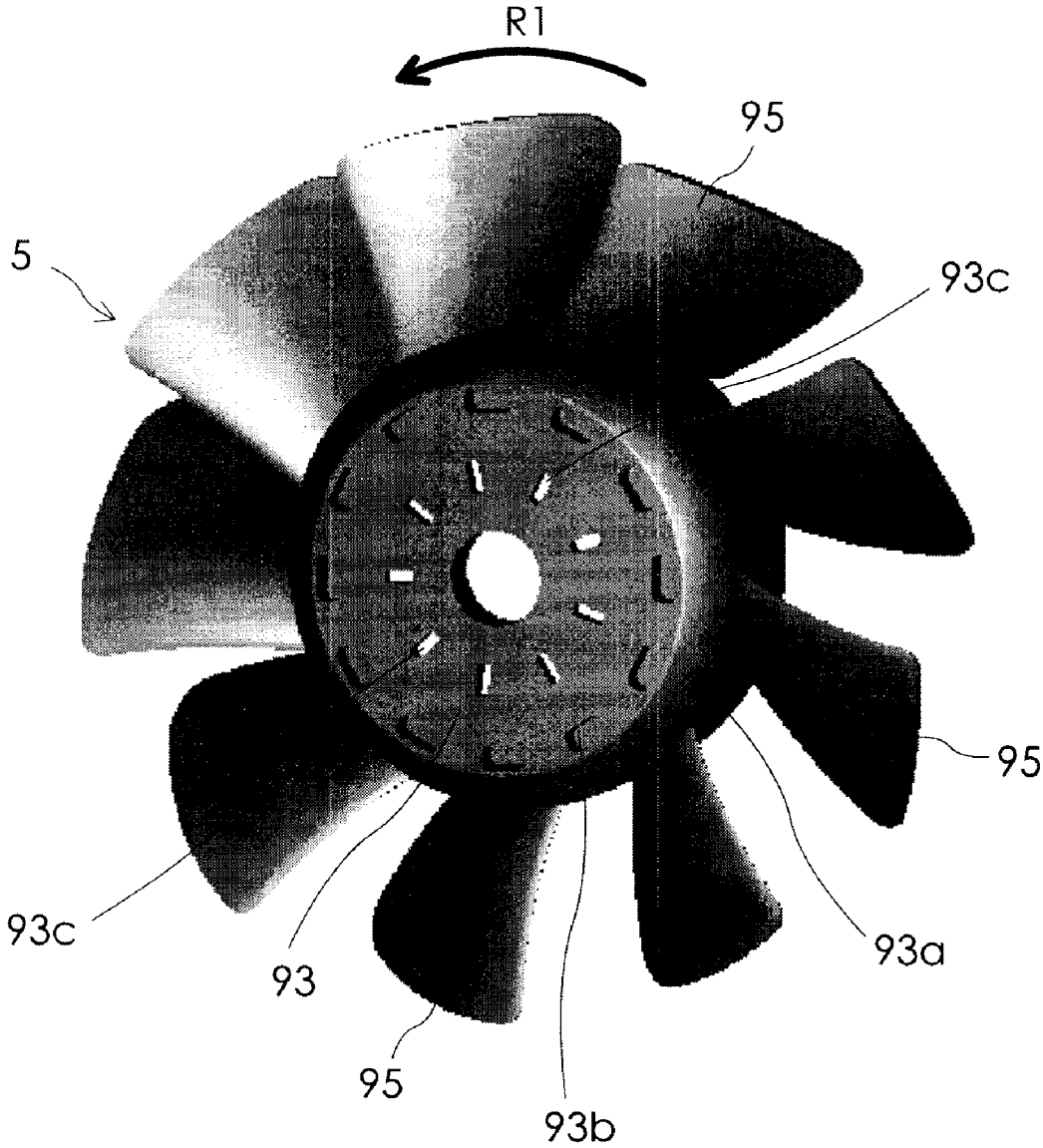
FIG. 10 is a perspective view of a first impeller of the counter-rotating axial-flow fan shown in FIG. 1.

As shown in FIG. 10, the first impeller 5 includes the cup-like member 93 and nine blades 95. The cup-like member 93 includes the peripheral wall portion 93*a* onto which the nine blades 95 are fixed and a bottom wall portion 93*b* integrally formed with one end of the peripheral wall portion 93*a*. One end of the rotary shaft 71 of the first motor 3 is connected to the bottom wall portion 93*b*. A plurality of ventilation slots 93*c* are formed in the bottom wall portion 93*b* and are disposed in the circumferential direction of the rotary shaft 71 at equidistant intervals. Each ventilation slot 93*c* has an elongated shape that extends in the radial direction of the rotary shaft 71 of the first motor 3. The ventilation slots 93*c* serve to introduce air sucked through the suction opening 11*a* into an internal space of the first motor 3.

As described above, the annular member 89 of the rotor 75 is fixed inside the peripheral wall portion 93*a* of the cup-like member 93 of the first impeller 5. Thus, the first impeller 5 is rotated by the first motor 3 in a first rotating direction R1, which is a counterclockwise direction in the page of FIG. 10, within the first space S1.

As shown in FIG. 1, the second motor includes the rotary shaft 171, a stator 173, and a rotor 175. The rotary shaft 171 is rotatably supported onto the second bearing holder 177 by two bearings 179 fitted into the second bearing holder 177. The rotary shaft 171 rotates in a direction opposite to the rotating direction of the rotary shaft 71 of the first motor 3. Structures of the rotary shaft 171, stator 173, and rotor 175 are the same as those of the rotary shaft 71, stator 73, and rotor 75 of the first motor 3, respectively. Thus, 100 is added to reference numerals assigned to the rotary shaft, stator, and rotor of the first motor 3, and descriptions of the rotary shaft, stator, and rotor of the second motor 7 will be omitted.

Figure 11:
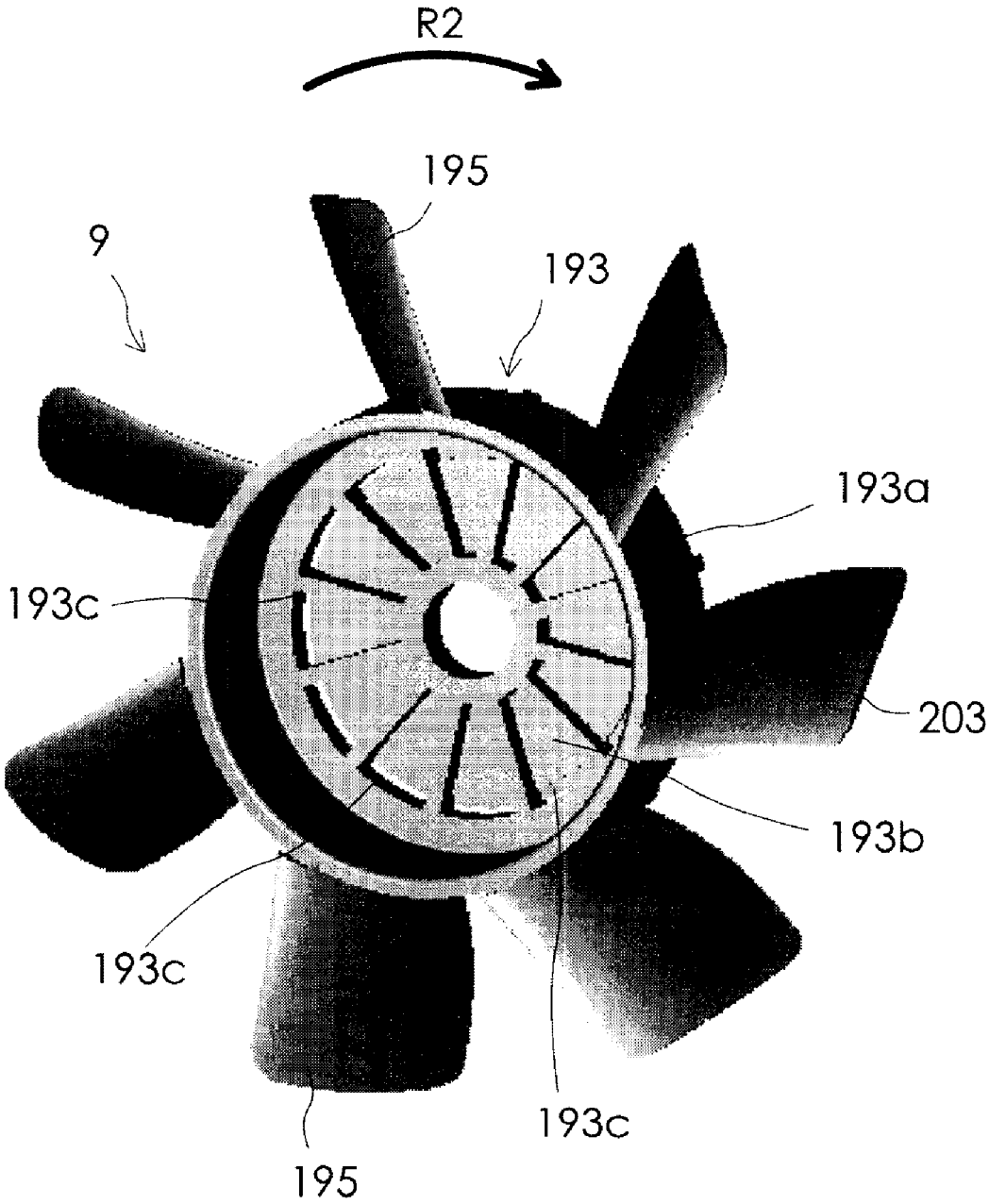
FIG. 11 is a perspective view of a second impeller of the counter-rotating axial-flow fan shown in FIG. 1.

As shown in FIG. 11, the second impeller 9 includes a cup-like member 193 and seven blades 195. The cup-like member 193 includes a peripheral wall portion 193*a* onto which the seven blades 195 are fixed and a bottom wall portion 193*b* integrally formed with one end of the peripheral wall portion 193*a*. One end of the rotary shaft 171 of the second motor 7 is fixed onto the bottom wall portion 193*b*. A plurality of ventilation slots 193*c* are formed in the bottom wall portion 193*b* and are disposed at equidistant intervals in the circumferential direction of the rotary shaft 171, being disposed apart from the rotary shaft 171. Each ventilation slot 193*c* has an elongated arc shape and extends in the circumferential direction of the rotary shaft 171 of the second motor 7. The ventilation slots 193*c* serve to discharge air introduced into the internal space of the second motor 7 to the outside. As shown in FIG. 1, an annular member 189 of the rotor 175 of the second motor 7 is fixed inside the peripheral wall portion 193*a* of the cup-like member 193 of the second impeller 9. As described above, the rotary shaft 171 of the second motor 7 rotates in the direction opposite to the rotating direction of the rotary shaft 71 of the first motor 3. Thus, the second impeller 9 is rotated by the second motor 7 in a second rotating direction R2, which is opposite to the first rotating direction R1 and is a clockwise direction in the page of FIG. 11, within the second space S2.

In the counter-rotating axial-flow fan in this embodiment, when the first impeller 5 rotates in the first rotating direction and the second impeller 9 rotates in the second rotating direction opposite to the first rotating direction, air sucked through the suction opening 11*a* is discharged from the discharge opening 13*a*, as shown in Fig, thereby cooling the inside of the electric appliance.

In the counter-rotating axial-flow fan in this embodiment, at least one raised portion 28*d* is provided at the side wall portions 28*b* in the pair of the first web half-portions 28A to 28E, and at least one raised or convex portion 55*d* is provided at the side wall portions 55*b* in the pair of the second web half-portions 55A to 55E. Then, the raised portions 28*d* and 55*d* extend beyond the virtual reference dividing plane F. The height of the side wall portions 28*b* and 55*b* may be thereby increased. As a result, lead wires may be much less likely to protrude or run off from between the side wall portions 28*b* and between the side wall portions 55*b*. Further, when the first and second divided housing units are coupled, a plurality of the lead wires may be much less likely to be sandwiched between the side wall portions of the first web half-portions 28A to 28E and second web half-portions 55A to 55E. In the counter-rotating axial-flow fan of the present invention, the engaging members 23A to 23D integrally formed with the first flange portion 19 and the engaged members 41A to 41D integrally formed with the second flange portion 37 are employed for the coupling structure that couples the first divided housing unit 11 and the second divided housing unit 13. Therefore, the coupling of the first divided housing unit 11 and the second divided housing unit 13 are attained not only by the engagement of the engaging members 23A to 23D and the engaged members 41A to 41D as well as by the fitting of the other end 21*a* of the first cylindrical air-channel half-portion 21 and the other end 39*a* of the second cylindrical air-channel half-portion 39. As a result, no force concentration will occur at the fitting structure of the first cylindrical air-channel half-portion and the second cylindrical air-channel half-portion. Moreover, the first and second divided housing units will not be readily disconnected or decoupled. In addition, the first stopper portions 25A to 25D are respectively provided adjacent to the engaging members 23A to 23D, and the second stopper portions 43A to 43D are respectively provided adjacent to the engaged members 41A to 41D. Thus, even if force is concentrated and applied from the first flange portion 19 and the second flange portion 37 to the engaging members 23A to 23D and the engaged members 41A to 41D when the first divided housing unit 11 and the second divided housing unit 13 are coupled, the leading ends of the first stopper portions 25A to 25D adjacent to the engaging members 23A to 23D are respectively abutted onto the leading ends of the second stopper portions 43A to 43D adjacent to the engaged members 41A to 41D. As a result, even if the engaging members 23A to 23D are strongly pressed against the engaged members 41A to 41D, it may be possible to prevent breakage of engagement portions where the engaging member 23A to 23D and the engaged member 41A to 41D are engaged with each other.

While the preferred embodiment of the invention has been described with a certain degree of particularity with reference to the drawings, obvious modifications and variations are possible in light of the above teachings. It is therefore to be understood that within the scope of the appended claims, the invention may be practiced other than as specifically described.

What is claimed is:

1. A counter-rotating axial-flow fan comprising:

a housing comprising a housing body including an air channel having a suction opening on one side in an axial line direction and a discharge opening on the other side in the axial line direction, and a motor support frame disposed in a central portion of the air channel;

a first impeller disposed in a first space, which is defined between the motor support frame in the housing and the suction opening, and including a plurality of blades;

a first motor including a first rotary shaft onto which the first impeller is fixed, the first motor rotating the first impeller in a first rotating direction within the first space;

a second impeller disposed in a second space, which is defined between the motor support frame in the housing and the discharge opening, and including a plurality of blades;

a second motor including a second rotary shaft onto which the second impeller is fixed, the second motor rotating the second impeller in a second rotating direction opposite to the first rotating direction within the second space; and a plurality of lead wires including at least two lead wires for supplying electric power to the first and second motors;

the motor support frame comprising a support frame body disposed in the central portion of the air channel and a plurality of webs disposed between the support frame body and the housing body at predetermined intervals in a circumferential direction of the rotary shafts, the webs connecting the support frame body and the housing body;

at least one of the webs having therein a lead wire guide path that guides at least some of the lead wires, the lead wire guide path communicating with an internal space of the support frame body and opened at an outside surface of the housing body;

the housing being constituted from first and second divided housing units that are coupled through a coupling structure;

the first divided housing unit including a first housing-body half-portion and a first support-frame half-portion, the first housing half-portion having the suction opening at one end thereof and containing therein the first space, the first support-frame half-portion being obtained by dividing the motor support frame into two along a virtual reference dividing plane extending in a radial direction of the rotary shafts orthogonal to the axial line direction;

the second divided housing unit including a second housing-body half-portion and a second support-frame half-portion, the second housing-body half-portion having the discharge opening at one end thereof and containing therein the second space, the second support-frame half-portion being obtained by dividing the motor support frame into two along the virtual reference dividing plane;

the first support-frame half-portion and the second support-frame half-portion respectively including a first support-frame-body half-portion and a second support-frame-body half-portion, which are obtained by dividing the support frame body into two so that the first and second support-frame-body half-portions are abutted onto each other on the virtual reference dividing plane, the first support-frame half-portion and the second support-frame half-portion respectively including a plurality of first web half-portions and a plurality of second web half-portions, which are obtained by dividing the plurality of webs into two along the virtual reference dividing plane;

the first and second web half-portions, which constitute the web including therein the lead wire guide path, each including a pair of side walls, the pair of side walls of the first web half-portion and the pair of side walls of the second web half-portion being abutted onto each other when the first and second web half-portions are combined with each other, wherein one or more raised portions are integrally formed with each of the side walls in the pair of the first web half-portion, the raised portion projecting toward the second web half-portion beyond the virtual reference dividing plane;

one or more raised portions are integrally formed with each of the side walls in the pair of the second web half-portion, the raised portion projecting toward the first web half-portion beyond the virtual reference dividing plane;

one or more recessed portions are formed in each of the side walls in the pair of the first web half-portion, and are respectively fitted with the one or more raised portions corresponding thereto of the second web half-portion; and one or more recessed portions are formed in each of the side walls in the pair of the second web half-portion, and are respectively fitted with the one or more raised portions corresponding thereto of the first web half-portion.

2. The counter-rotating axial-flow fan according to claim 1, wherein one of the raised portions and one of the recessed portions are formed in each of the side walls, and an end surface of the side wall where the raised and recessed portions are not formed is in the virtual reference dividing plane.

3. The counter-rotating axial-flow fan according to claim 2, wherein the one raised portion and the one recessed portion formed in one of the side walls in the pair are opposed to the one raised portion and the one recessed portion formed in the other side wall in the pair in the circumferential direction.

4. The counter-rotating axial-flow fan according to claim 1, wherein a contour shape of the raised portion and a contour shape of the recessed portion are respectively a trapezoid.

5. The counter-rotating axial-flow fan according to claim 4, wherein the contour shape of the raised portion and the contour shape of the recessed portion are respectively an isosceles trapezoid, the raised portion and the recessed portion respectively have two inclined surfaces that correspond to the trapezoid's pair of non-parallel opposite sides of equal length, and one of the two inclined surfaces of the raised portion is continuous with one of the two inclined surfaces of the recessed portion adjacent to the raised portion.

6. The counter-rotating axial-flow fan according to claim 1, wherein only one of the webs includes therein the lead wire guide path, and all of the lead wires pass through the lead wire guide path.

7. The counter-rotating axial-flow fan according to claim 6, wherein the webs other than the one web including therein the lead wire guide path are respectively divided into two along the virtual reference dividing plane.

* * * * *